US005882246A

United States Patent [19]

Inkyo et al.

[11] Patent Number: 5,882,246

[45] Date of Patent: Mar. 16, 1999

[54] WET AGITATING BALL MILL AND METHOD

[75] Inventors: Mitsugu Inkyo; Toshiya Kitakaze; Takashi Tahara, all of Hiroshima, Japan

[73] Assignee: Kotobuki Eng. & Mfg. Co., Ltd., Tokyo, Japan

[21] Appl. No.: 793,271

[22] PCT Filed: May 27, 1996

[86] PCT No.: PCT/JP96/01452

§ 371 Date: Feb. 5, 1997

§ 102(e) Date: Feb. 5, 1997

[87] PCT Pub. No.: WO96/39251

PCT Pub. Date: Dec. 12, 1996

[30] Foreign Application Priority Data

Jun. 6, 1995 [JP] Japan ..... 7/139652

[51] Int. Cl.[6] ..... B24C 9/00

[52] U.S. Cl. ..... 451/87; 451/28; 241/172; 241/32; 241/171

[58] Field of Search ..... 241/170, 171, 241/175, 176, 177, 178, 179, 184, 69, 33, 79, 172; 451/50, 87, 28, 326, 328

[56] References Cited

U.S. PATENT DOCUMENTS

| | | | |
|---|---|---|---|
| 3,486,705 | 12/1969 | Szegvari | 241/172 |
| 3,993,254 | 11/1976 | Bicik et al. | 241/69 |
| 4,108,385 | 8/1978 | Funk | 241/172 |
| 4,834,301 | 5/1989 | Inkyo et al. | 241/171 |
| 5,199,656 | 4/1993 | Szegvari et al. | 241/172 |
| 5,312,055 | 5/1994 | Barthelmess et al. | 241/172 |
| 5,566,896 | 10/1996 | Stehr et al. | 241/171 |
| 5,597,126 | 1/1997 | Frommherz et al. | 241/172 |
| 5,620,147 | 4/1997 | Newton | 241/171 |
| 5,630,557 | 5/1997 | Barthelmess | 241/171 |

FOREIGN PATENT DOCUMENTS

| | | | |
|---|---|---|---|
| 1288890 | 2/1969 | Germany | 241/172 |
| 4-61635 | 5/1992 | Japan . | |

*Primary Examiner*—David A. Scherbel
*Assistant Examiner*—Derris H. Banks
*Attorney, Agent, or Firm*—Flynn, Thiel, Boutell & Tanis, P.C.

[57] ABSTRACT

In a wet agitating ball mill, a shaft 5 rotated and driven by a motor is hollow at its axial center at an upper portion, a discharge route 9 communicating with a slurry discharge port is provided, and a rotor 11 is affixed at the lower portion of the shaft. A separator 4 is composed of a pair of disks 21 and a blade 22 for coupling both disks to form an impeller, and by its rotation, a centrifugal force is applied to the slurry and media getting in the separator 4, and by the difference in specific gravity of the two, accordingly, the media having the heavier specific gravity is expelled and separated in the radial direction, while the slurry of the lighter specific gravity is discharged through the discharge route 9 of the shaft 5 in a state free from kinetic energy.

16 Claims, 9 Drawing Sheets

WET AGITATING BALL MILL AND METHOD

The present invention relates to a wet agitating ball mill of the friction grinding type, a grinding method by using this mill, and a method of recovering ground product.

BACKGROUND ART

A wet agitating ball mill of the friction grinding type is generally composed of a cylindrical enclosed stator, a rotor of the pin, disk or annular type disposed in the axial center of the stator to be rotated and driven by the motor, and the mill is filled with a media such as zirconia, glass beads, titanium oxide, steel balls or zirconia silicate, and the raw slurry in a material tank is supplied into the mill through a material pump, and the rotor is rotated and driven to agitate and mix the media and slurry, thereby grinding the slurry. The ground slurry is discharged out of the mill after separating the media by the separator, and is returned into the material tank. This operation is repeated and grinding is promoted. When reaching a desired product particle size, the mill is stopped, and the slurry in the material tank is transferred and collected in a product tank. After stopping the mill, the product slurry left over in the mill remains in the mill, but if it can solidify to disturb the next operations, the inside of the mill was cleaned by feeding cleaning water while operating the mill, and the slurry, diluted by the cleaning water and discharged from the mill, was discarded.

The media used in this type of mill were reduced in diameter as the product grain size became smaller according to the requests of customers and it was not rare to use media with a diameter of about 0.1 mm. One of the problems that must be solved in the mill for such fine pulverizing is the separation technology for separating the media efficiently from the slurry. As the separator for separating media from the slurry, hitherto, the screen and slit machines were used, but in the former screen type, it is extremely difficult to drill innumerable holes smaller than the media diameter, and if fabricated, the pressure loss is large, and clogging is likely to occur. In the latter slit mechanism, a representative example is composed of a disk fixed on a stator and a disk to be rotated fixed on the shaft and forming a slit which does not allow media to pass against the fixed disk by keeping a specific clearance to the fixed disk, and the media is separated in the slit between the disks, and the slurry is discharged through the slit, but it is extremely difficult to manufacture a slit width of about 0.1 mm, and if manufactured, the media are likely to be caught in the slit, and the disk is damaged easily. Additionally, since the slit width is narrow, there is limited slurry discharge amount, that is, grinding treating capacity of slurry.

As a separator capable of solving these problems, Japanese Laid-open Patent 4-61635 discloses a separator having two disks disposed parallel at a specific interval on the shaft, and coupling both disks by a spiral blade in an impeller form. This separator is designed to apply a centrifugal force to the media and slurry, and scatter the media having the greater specific gravity radially outward by making use of difference in specific gravity between the media and slurry, while discharging the slurry of the smaller specific gravity from a discharge route around the shaft and, therefore, since the same centrifugal force acts on the same diameter between the disks, the spacing of the disks can be widened and the treating capacity may be increased, and by widening the spacing of the disks, biting or clogging of the media in the disks can be avoided. Hence, the separation performance does not change with time and a stable operation is realized for a long period, and the media can be separated if the diameter is small, and micro media can be used, and fine pulverizing is hence possible, but in spite of these benefits, on the other hand, the slurry discharged from the discharge route around the shaft has a kinetic energy given by the rotation of the separator, that is, the action of centrifugal force, which means the kinetic energy is released wastefully, and unnecessary power is spent.

This separator is usually made of metal, but considering the contamination and wear by metal, it is preferred to use a ceramic. In the case of ceramics, it is extremely difficult to fabricate an integral body. Manufacturing the disks and blade separately, they can be assembled by adhering with an adhesive, but when the raw slurry comprises an organic solvent, the adhesive may fuse to have adverse effects on the quality of product slurry, or the separator may disassemble into individual parts.

Other problems occurring in the mill for fine pulverizing are the inaction of a mating ring or loss of function of a mechanical seal, in the mechanical seal as shown in FIG. 5 provided for shaft sealing of the shaft bearing portion, as the slurry and media get in and solidify in the clearance between the lower side of the fitting groove to which the O-ring is fitted and the mating ring.

It is a first object of the invention to present a method of recovering product slurry remaining in the mill after grinding, and it is a second object to present a grinding method capable of grinding efficiently by a mill.

It is a third object of the invention to decrease the power of operating a mill using the separator of the above impeller type, and it is a fourth object to avoid loss of function of the mechanical seal by preventing clogging by media and slurry that may impede the function of mating ring of mechanical seal. It is a fifth object to assemble easily the separator with disks and blades without using an adhesive.

DISCLOSURE OF THE INVENTION

In the invention for achieving the first purpose, a screen is provided in the mill bottom, and after grinding, the product slurry remaining in the mill is discharged and recovered through the screen by injecting compressed air or a compressed gas such as $N_2$ gas from above the mill.

According to the method of the invention, the product slurry remaining in the mill after grinding can be effectively recovered.

In the method of the invention, it is predicted that clogging may occur in the screen during recovery. To solve this problem, various methods may be considered, including a method of rotating and driving the rotor during recovery to agitate in the mill so that the media may not collect near the screen, a method of recovering over a longer time by decreasing the recovery speed (recovery amount per unit time), and a method of blowing compressed air or a compressed gas such as $N_2$ gas from the opposite side of the screen to prevent clogging of the screen by back wash, and when rotating and driving the rotor, it is desired to drive it at a lower speed than when grinding so as to save the power required for rotating the rotor and keep low the temperature rise due to the rotor rotation.

In the invention for achieving the second object, the filling rate of the media in the mill is 80 to 90% during grinding.

According to the experiment by the present inventors, the relation between the power kWh required for obtaining 1 kg of product slurry and the media filling rate in the mill is as shown in FIG. 9, in which the least power was required for obtaining product slurry of a unit weight at a medium filling rate of 80 to 90%. It means that the most efficient grinding is achieved when the mill is operated at a media filling rate of 80 to 90%.

In the mill according to the invention, the separator may be a screen or slit mechanism, but the above impeller type separator is preferred due to the reasons mentioned above. In this case, if the mill is lateral, the media filling rate cannot be increased. That is, when loading media into the mill after stopping its operation, the filling capacity in the mill is about half, and when the level reaches the discharge route, media escape from the discharge route. It is hence desired to install the mill vertically, and provide the separator in the upper part of the mill, and when the media filling rate is set at 80 to 90%, as mentioned above, grinding is done most efficiently, and the separator can be positioned higher than the medium filling level, which is also effective to prevent the media from being placed on the separator and discharged.

The invention for achieving the third object relates to a wet agitating ball mill comprising a cylindrical separator, a feed port of slurry provided at one end of the stator, a discharge port of slurry provided at the other end of the stator, a rotor of the pin, disk or annular type for agitating and mixing the media loaded in the stator and the slurry supplied from the feed port, and a separator of the impeller type linked to the discharge port and rotating together with the rotor or rotating independently of the rotor to separate the media and slurry by the action of centrifugal force and discharge the slurry from the discharge port, wherein the axial center of the shaft for rotating and driving the separator is a hollow discharge port communicating with the discharge port.

According to the mill of the invention, the slurry from which media is separated by the separator is discharged through the axial center of the shaft, but since the centrifugal force does not act on the axial center, the slurry is discharged in a state having no kinetic energy. That is, kinetic energy is not discharged wastefully, and wasteful power consumption is avoided.

The mill of the invention may be lateral, but the vertical position is preferred because of the above reason, that is, to increase the media filling rate, and the discharge port is provided at the mill upper end. The separator is also preferred to be installed higher than the media filling level.

When the discharge port is provided at the mill upper end, the feed port is provided in the mill bottom. In a preferred mode, the feed port is composed of a valve seat, and a valve body having a V-, trapezoid or cone shape fitted elevatably to the valve seat and contacting linearly with the edge of the valve seat, and by forming an annular slit so as not to allow media to pass between the edge of the valve seat and the valve body having the V-, trapezoid or cone shape, the raw slurry is fed but falling of the media can be prevented. Moreover by lifting the valve body, it is possible to expand the slit to discharge the media, or by lowering the valve body, it is possible to close the slit and shut the mill tightly. Moreover, since the slit is formed by the valve body and edge of the valve seat, coarse particles in the raw slurry hardly get in, and if they do get in, they pass through upward or downward, and hardly clog.

Moreover, by vibrating the valve body vertically by vibrating means, coarse particles caught in the slit may be drawn out of the slit, and biting itself hardly occurs. Still more, as a shearing force is added to the raw slurry by vibration of the valve body, the viscosity drops, thereby increasing the raw slurry amount passing into the slit, that is, the feed rate. The vibrating means for vibrating the valve body includes mechanical means such as a vibrator, and means for varying the pressure of the compressed air acting on the piston which is integrated with the valve body, such as a reciprocating compressor, and an electromagnetic changeover valve for changing from suction to discharge of the compressed air.

The mill of the invention is further preferred to be provided with a screen for separating the media and a take-out port for product slurry in the bottom as mentioned above, so that the product slurry remaining in the mill after grinding may be taken out.

The invention for achieving the fourth object relates to a vertical wet agitating ball mill comprising a cylindrical vertical stator, a feed port for product slurry provided in the bottom of the stator, a discharge port for slurry provided at the upper end of the stator, a shaft pivoted on the upper end of the stator and rotated and driven by a driving means such as a motor, a rotor of the pin, disk or annular type fixed on the shaft for agitating and mixing the media loaded in the stator and the slurry supplied from the feed port, a separator disposed near the discharge port for separating media from the slurry, and a mechanical seal provided in the bearing unit for supporting the shaft at the stator upper end, wherein a taper notch expanding downward is formed at the lower side of an annular groove to which an O-ring contacting with the mating ring of the mechanical seal is fitted.

According to the mill of the invention, the mechanical seal is provided at the axial center where the medium and slurry have almost no kinetic energy, and at the upper end of the stator above their liquid levels, so that invasion of media or slurry between the mating ring of the mechanical seal and the lower side of the O-ring fitting groove can be substantially decreased. Moreover, since the lower side of the annular groove to which the O-ring is fitted is expanded downward through the notch and the clearance is widened, clogging due to invasion and solidification of the slurry or media hardly occurs, the mating ring follows up the seal ring smoothly, and the function of the mechanical seal is maintained. Incidentally, the lower side of the fitting groove to which the O-ring is fitted has a V-form section, and the entire structure does not have a thin wall so that the strength is not sacrificed and the holding function of the O-ring is not spoiled.

The invention for achieving the fifth object relates to a wet agitating ball mill comprising a cylindrical stator, a feed port for slurry provided at one end of the stator, a discharge port for slurry provided at other end of the stator, a rotor of the pin, disk or annular type for agitating and mixing the media loaded in the stator and the slurry supplied from the feed port, and a separator of impeller type linked to the discharge port and rotating together with the rotor or rotating independently of the rotor to separate the media and slurry by the action of centrifugal force and discharge the slurry from the discharge port, wherein the separator is composed of two disks having a fitting groove of a blade in the confronting inner sides, a blade interposed between the disks by fitting to the fitting groove, and support means for supposing the disks having the blade placed therein from both sides, and in a preferred form, the support means is composed of a step of the shaft and forms a stepped shaft, and cylindrical pressing means for pressing the disks by fitting to the shaft, and the disks placing the blade therein is held and supported from both sides by the step of the shaft and pressing means.

BEST FORMS OF CARRYING OUT THE INVENTION

Figure 1:
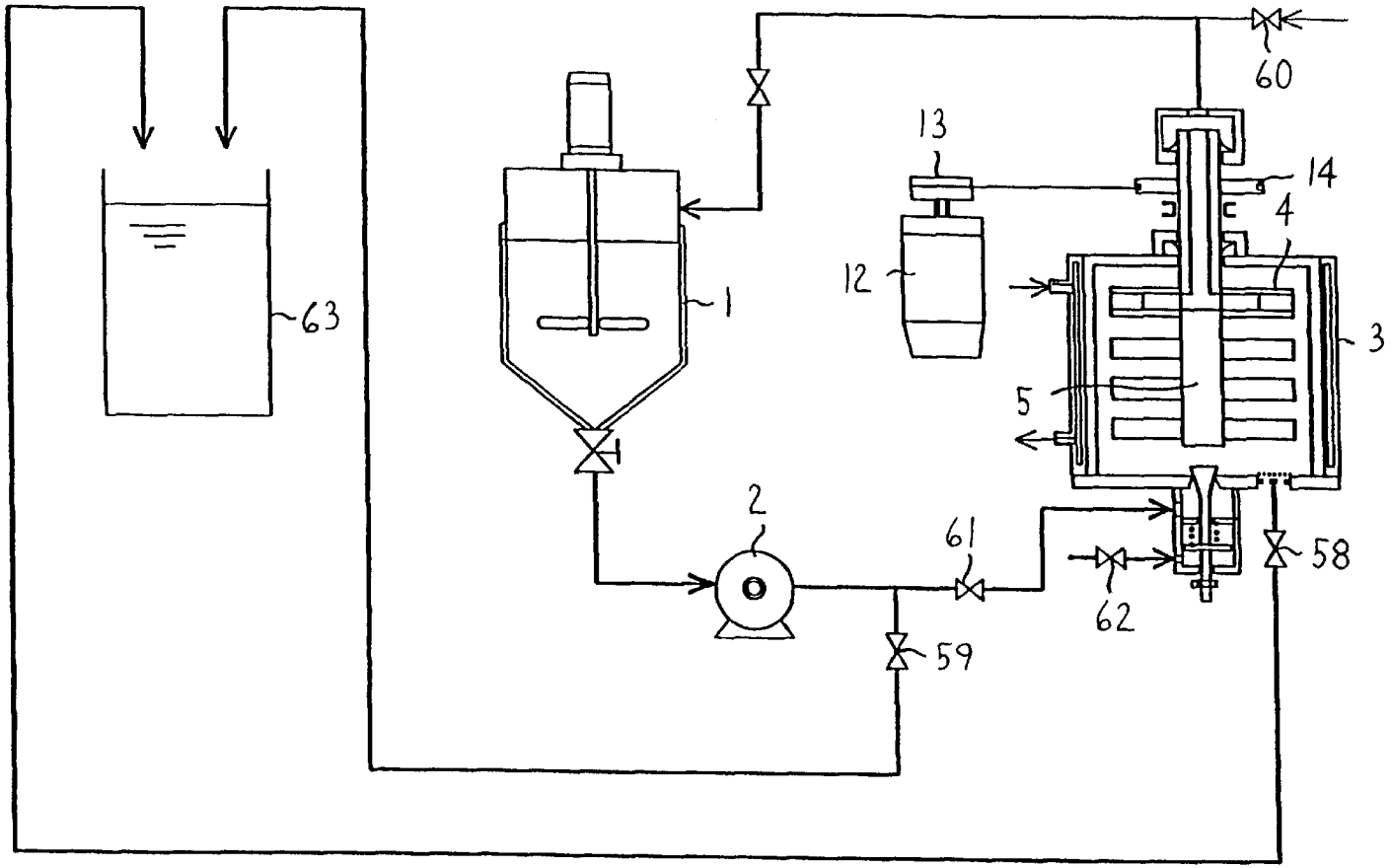
FIG. 1 is a schematic diagram of a raw slurry grinding process cycle having a wet agitating ball mill of the invention.

In FIG. 1, raw slurry discharged from a material tank 1 storing slurry by a material pump 2 is supplied into a vertical type wet agitating ball mill 3 of the friction grinding type, and is agitated and ground together with media in the mill 3, and is discharged through the axial center of a shaft 5 after separating the media by a separator 4, and returns to the tank 1, so that it may be ground cyclically by this route.

Figure 2:
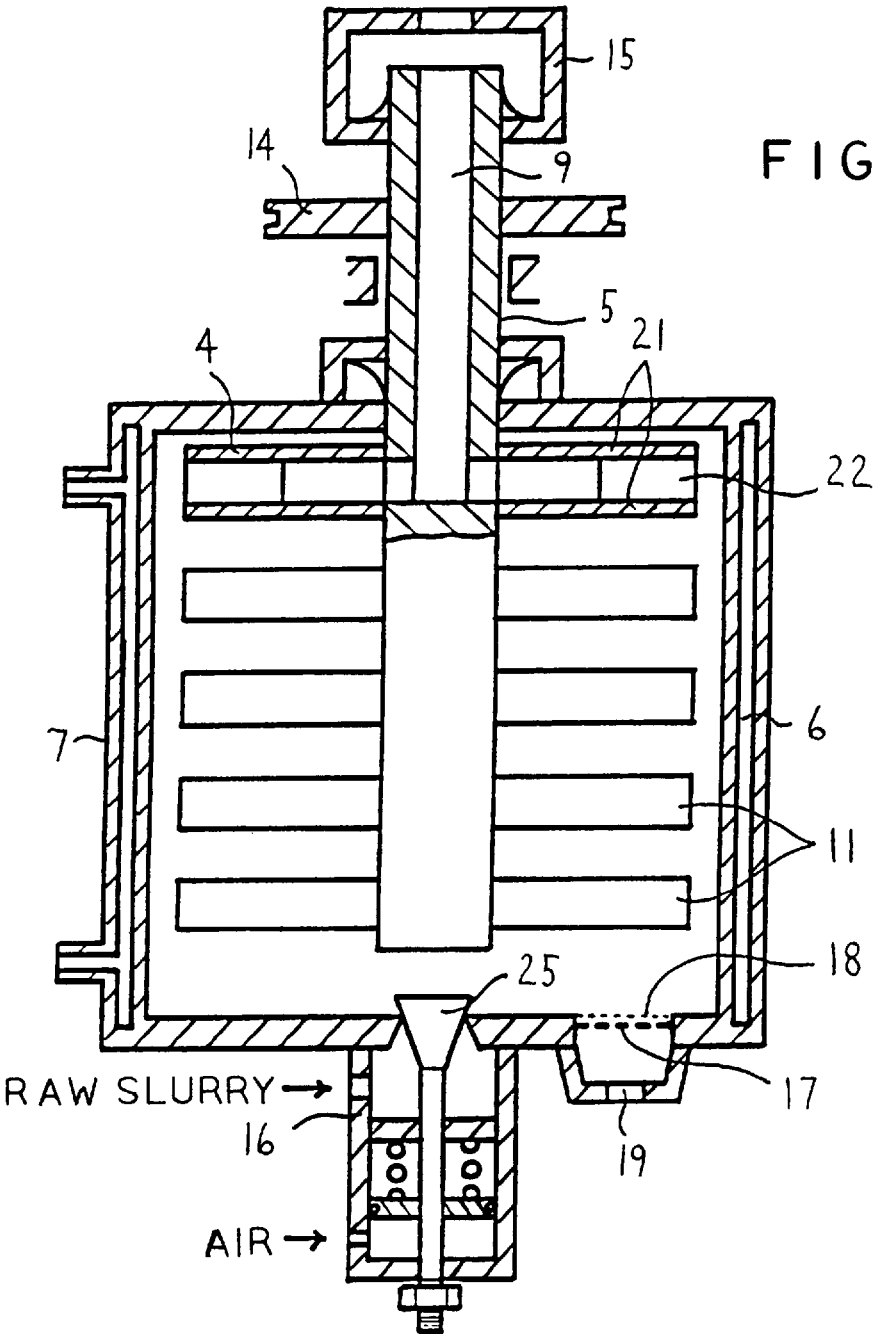
FIG. 2 is a longitudinal sectional view of a wet agitating ball mill of the invention.
Figure 6:
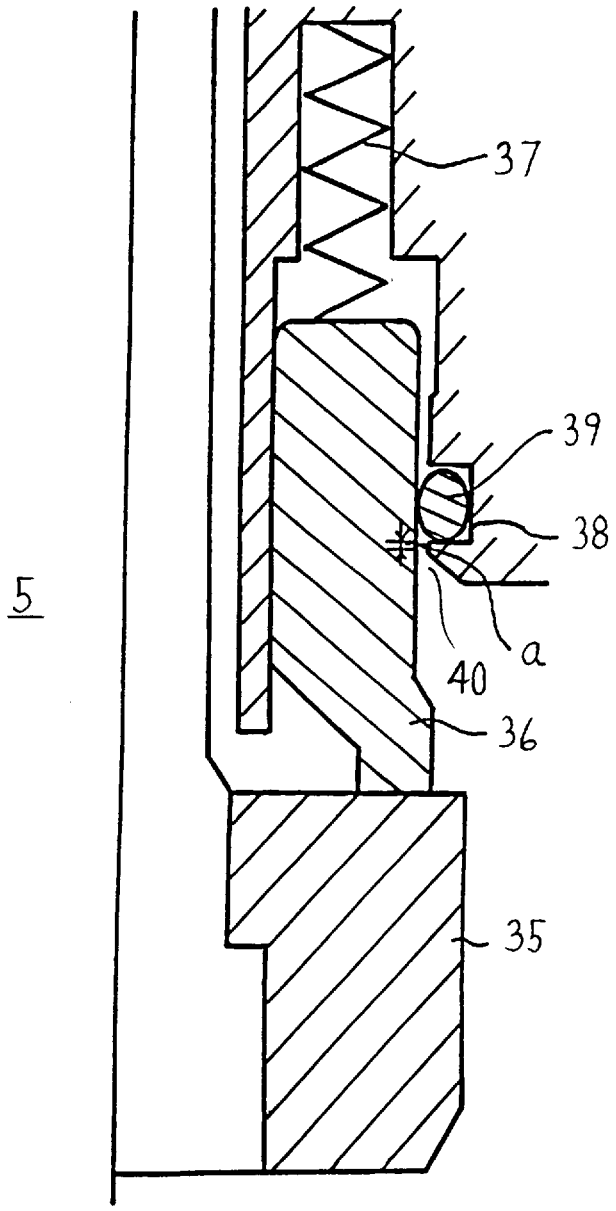
FIG. 6 is an essential magnified longitudinal sectional view of a mechanical seal used in a wet agitating ball mill.

The mill 3, as specifically shown in FIG. 2, comprises a stator 7 having a vertical cylindrical form including a jacket 6 for passing cooling water for cooling the mill, a shaft 5 mounted rotatably above the stator at the axial center of the stator 7 and having a mechanical seal as shown in FIG. 6 in the bearing unit and forming a hollow discharge route 9 in the axial center of the upper side, a rotor 11 of the pin or disk type projecting in the radial direction at the lower end of the shaft, a pulley 14 affixed above the shaft to be connected by a belt to a pulley 13 of a motor 12 shown in FIG. 1, a rotary joint 15 mounted at the opening end of the shaft upper end, a separator 5 for separating the media affixed on the shaft 5 near the upper part in the stator 7, a feed port 16 of raw slurry provided opposite to the shaft end of the shaft 5 in the stator bottom, and a screen 18 for separating the media, mounted on a grating shaped screen support 17 installed at a product slurry take-out port 19 provided at an eccentric position of the stator bottom.

The separator 4 comprises a pair of disks 21 affixed at a specific spacing on the shaft 5, and a blade 22 for linking the both disks 21, thereby forming an impeller, which rotates together with the shaft 5. Centrifugal force is applied to the media and slurry, having entered in between the disks, and the media is scattered radially outward by the difference in specific gravity, while the slurry is discharged through the discharge route 9 at the axial center of the shaft 5.

Figure 3:
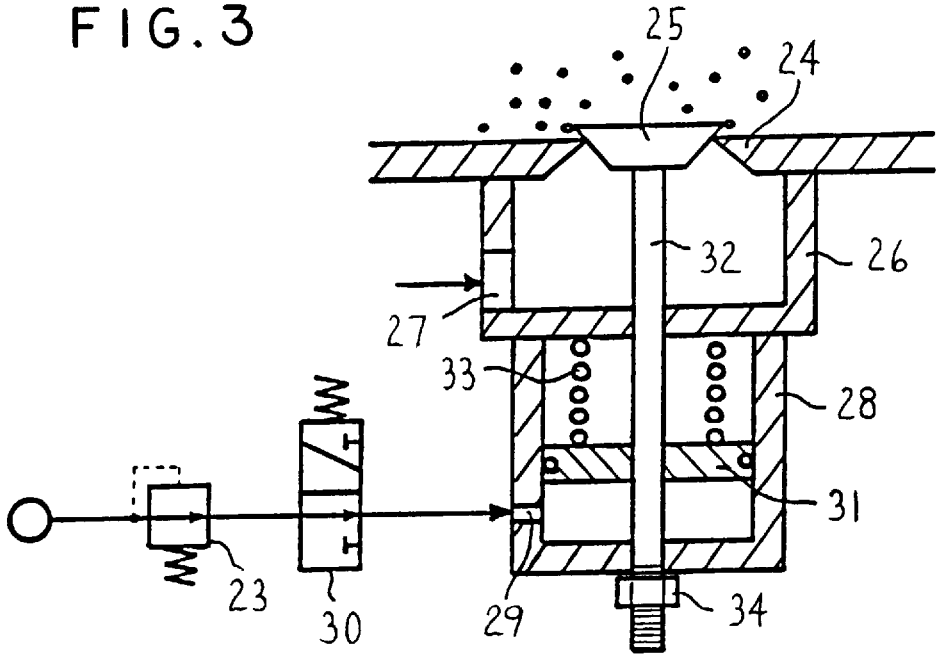
FIG. 3 is a longitudinal sectional view of a feed port when feeding raw slurry.

The feed port 16 for raw slurry comprises, as specifically shown in FIG. 3, a valve seat 24 formed in the stator bottom, a valve body 25 of an inverted trapezoidal form elevatably fitting to the valve seat 24, a cylindrical body 26 with a bottom forming a guide port 27 for raw slurry, projecting downward from the stator bottom, a cylindrical body 28, with a bottom forming a guide port 29 for air, projecting downward from the cylindrical body 26, a piston 31 elevatably fitted to the cylindrical body 28, a rod 32 for linking the piston 31 and valve body 25, a spring 33 mounted on the piston in the cylindrical body 28 for pushing down the piston 31 to thrust the valve body 25 downward, and a nut 34 threaded onto the rod end projecting from the cylindrical body 28 and mounted so as to be adjustable in position, and when the valve body 25 is pushed up by the supply of raw slurry, an annular slit is formed against the valve seat 24, so that the raw slurry can be supplied into the mill, and the slit width can be adjusted by tightening or loosening the nut 34, and when feeding the material, if the nut 35 hits against the cylindrical body 28 and is expanded to the maximum limit, the width is set so that media cannot pass through. When feeding the material, the valve body 25 ascends by resisting the pressure in the mill and action of the spring 33 by the feed pressure of the raw slurry fed into the cylindrical body 26, and a slit is formed against the valve seat 24, but the feed pressure of the raw slurry is set so that the width of the slit formed by the supply of raw slurry may be slightly smaller than the maximum slit width defined by the nut 34, and therefore a certain allowance is kept between the nut 34 and cylindrical body 28.

Coarse particles are contained in the raw slurry supplied into the mill through the slit formed between the valve seat 24 and valve body 25, and they may be predicted to be caught between the valve seat and valve body to clog, and if clogged by biting, the feed pressure is raised so as to lift the valve body 25 once to the maximum limit to extend the slit width to a maximum. As a result, the caught coarse particles flow out and the clogging is cleared. When the clogging is cleared, the feed pressure is lowered and the valve body 25 descends.

To clear clogging in the slit, moreover, in the illustrated example, compressed air is supplied from a compressed air source (not shown) into the cylindrical body 28 from the guide port 29 through regulator 23 and electromagnetic changeover valve 30, and by changing over the electromagnetic changeover valve 30 by turning it on and off repeatedly in a short period, compressed air is supplied intermittently, and the valve body 25 repeats vertical motion to ascend to the upper limit in a short period, so that the clogging can be cleared.

The vibration of the valve body 25 may be conducted constantly, or when lots of coarse particles are contained in the raw slurry, or the vibration may occur in cooperation when the feed pressure of the raw slurry is raised due to clogging.

Figure 4:
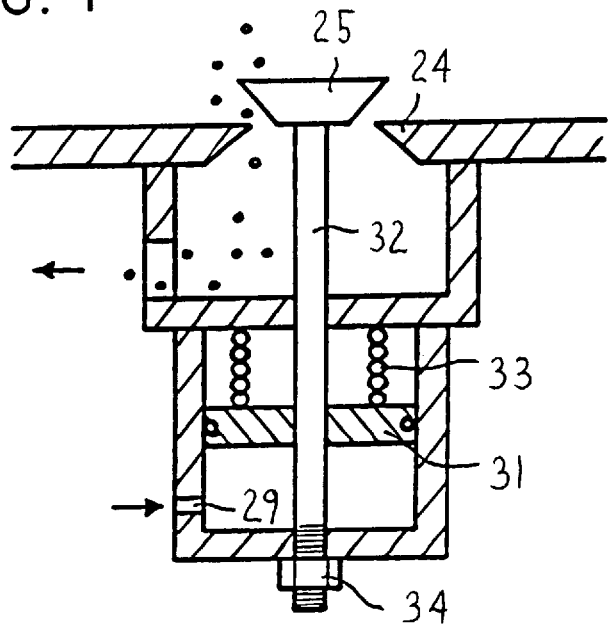
FIG. 4 shows the valve body in a raised position.

After grinding, when taking out the agitated media together with the product slurry, or after discharging the product slurry, as shown in FIG. 4, the mounting position of the nut 34 is lowered. Then the electromagnetic changeover valve 30 is changed over to ON position. As a result, the compressed air introduced from the guide port 29 lifts the valve body 25 above the edge of the valve seat 24.

Figure 5:
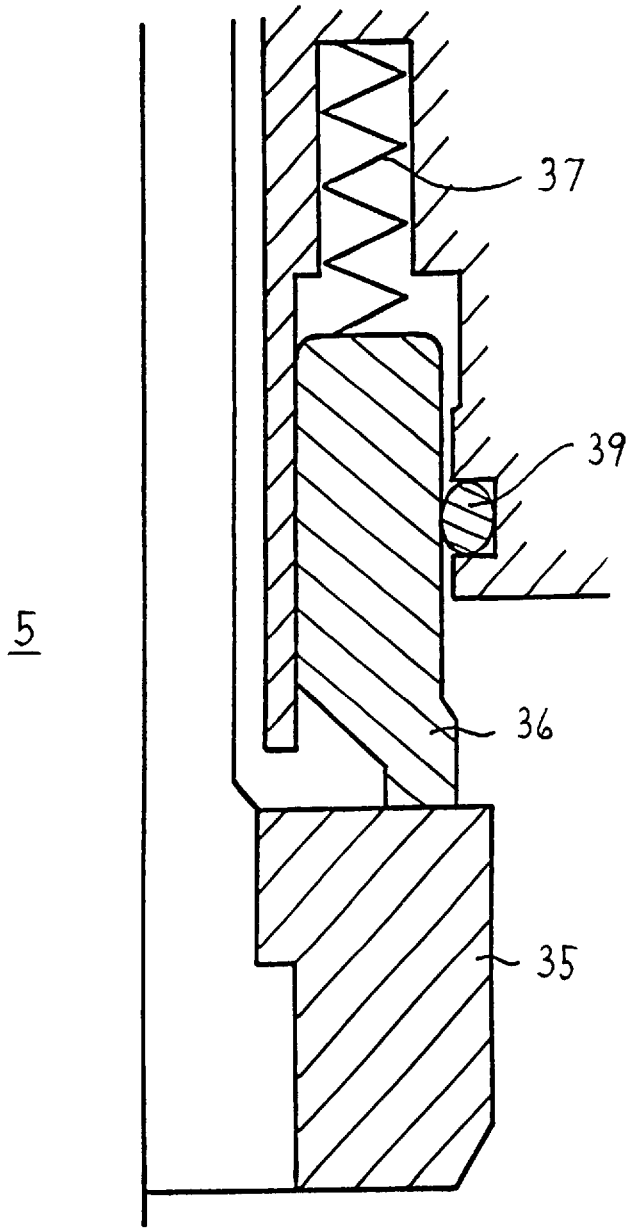
FIG. 5 is a longitudinal sectional view of the feed port when discharging media.

In the mechanical seal, as specifically shown in FIG. 5 and FIG. 6, a mating ring 36 at the stator side is press-fitted to a seal ring 35 fixed to the shaft 5 by the action of a spring 37, and sealing of the stator 7 and mating ring 36 is achieved by an O-ring 39 fitted in a fitting groove 38 at the stator side, and in FIG. 6, a tapered notch 40 expanding downward is cut at the lower end of the O-ring fitting groove 38, and the length a of the minimum clearance portion between the lower side of the fitting groove 38 and mating ring 36 is narrower than in FIG. 5, thereby preventing invasion and solidification of the media and slurry, impedance of the motion of the mating ring 36, and the loss of sealing of the seal ring 35.

Figure 10:
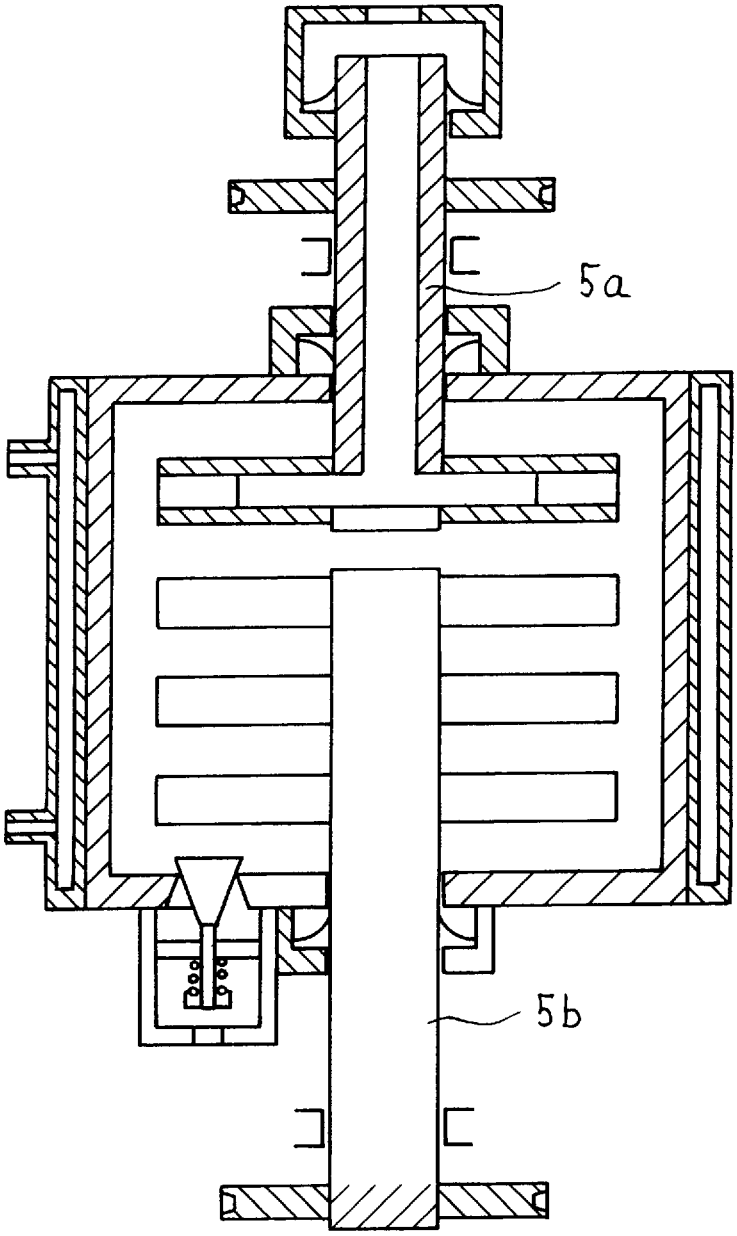
FIG. 10 is a longitudinal sectional view of another embodiment of a wet agitating ball mill.

In this embodiment, the rotor 11 and separator 4 are fixed on the same shaft 5, but in another embodiment, they are fixed on different shafts 5*a*, 5*b* disposed coaxially and are rotated and driven independently as shown in FIG. 10. In the above embodiment where the rotor and separator are mounted on the same shaft, only one driving device is needed and the structure is simple, and in the latter embodiment where the rotor and shaft are mounted on different shafts and are rotated and driven by individual driving devices, on the other hand, the rotor and separator can be rotated and driven at optimum rotating speeds, individually.

Figure 7:
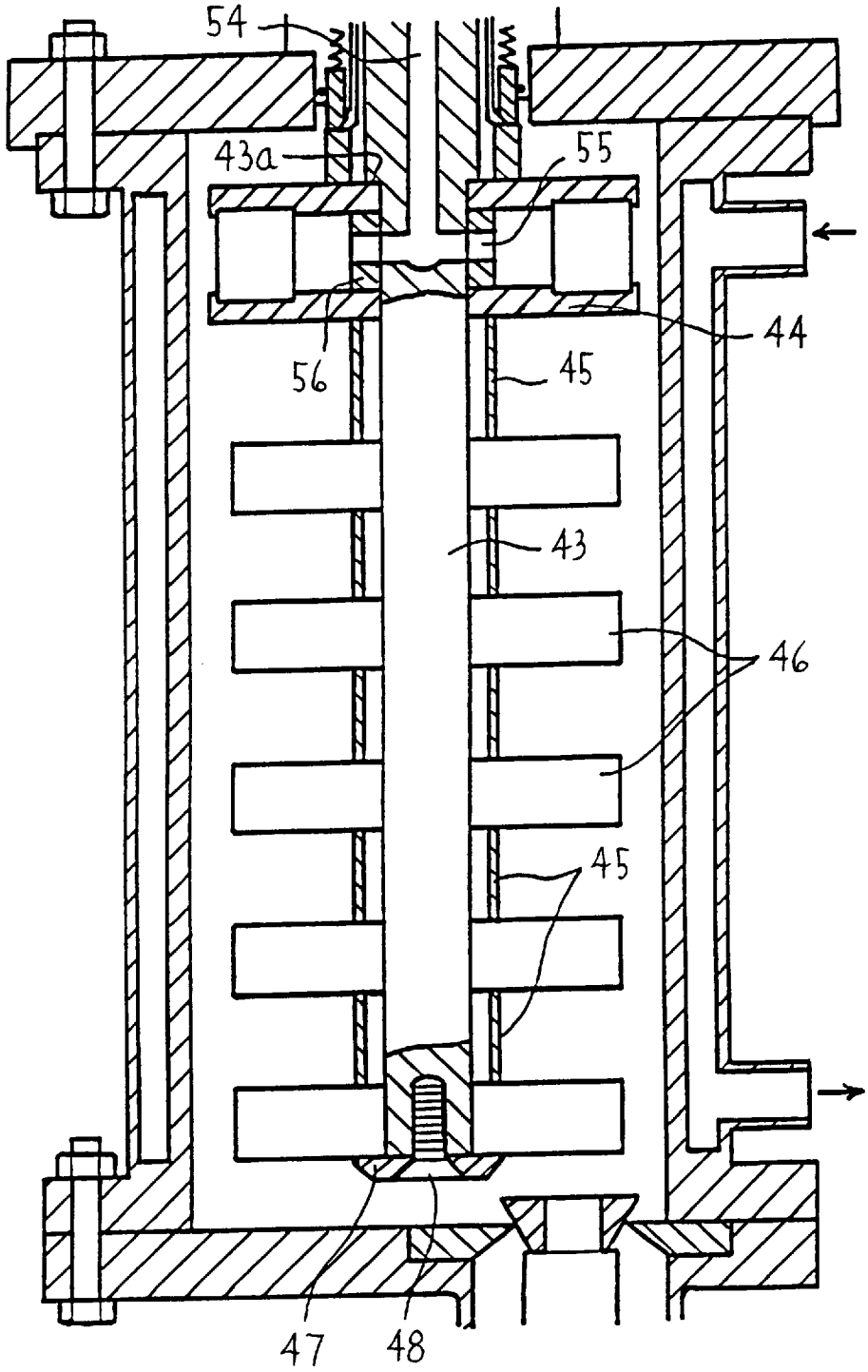
FIG. 7 is a longitudinal sectional view of another example of a wet agitating ball mill of the invention.
Figure 8:
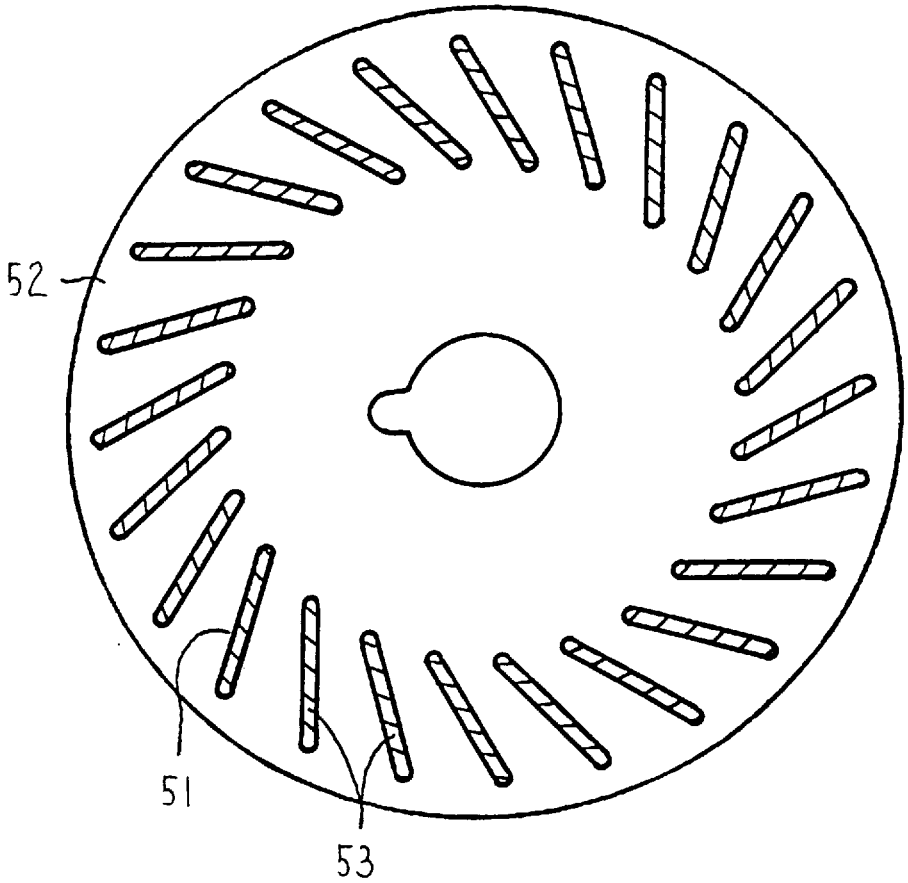
FIG. 8 is a lateral sectional view of a separator of the wet agitating ball mill shown in FIG. 7.

In the ball mill shown in FIG. 7, shaft 43 is a stepped shaft, a separator 44 is provided at the upper end of the shaft, a spacer 45 and a rotor 46 of the disk or pin form are provided alternately below the separator 44, a stopper 47 is fixed to the lower end of the shaft by a screw 48, and after the separator 44, spacer 45, and rotor 46 are inserted onto the shaft 43, they are fixed by pinching, with the step 43*a* of the shaft 43 and the stopper 47, and the separator 44 comprising, as shown in FIG. 8, a pair of disks 52 formed with blade fitting grooves 51 on the inside confronting sides, a blade 53 interposed between the disks and fitting in the blade fitting grooves 51, and an annular spacer 56 forming a hole 55 communicating with a discharge route 54 and maintaining both disks 52 at a specific spacing, thereby composing an impeller.

A grinding method of raw slurry by employing the apparatus shown in FIG. 1 is described below.

The stator 7 in the ball mill 3 is filled with a media to 80 to 90% of the inner volume of the stator, the valves 58, 59 and 60 are closed, and valves 61 and 52 are opened, and first the motor 12 is driven, and then the material pump 2 is driven. When the motor 12 is driven, the rotor 11 and separator 4 are rotated, and when the material pump 2 is driven, the raw slurry in the material tank 1 is sent into the guide port 27 of the feed port 16 at a specific feed rate, and is supplied into the mill through the slit formed between the edge of the valve seat 24 and the valve body 25.

By rotation of the rotor 11, the raw slurry and media in the mill are agitated and mixed, and the slurry is ground, and by rotation of the separator 4, the media and slurry having entered into the separator are separated by the difference in specific gravity, and the media of greater specific gravity is scattered radially outward, while the slurry of smaller specific gravity is discharged through the discharge route 9 formed in the axial center of the shaft 5, and is returned to the material tank 1.

In this method, the motor 12 is driven prior to the driving of the material pump 2 because the media is discharged when raw slurry is supplied before the separating action by the separator.

The slurry returned to the material tank 1 is supplied again into the mill by the material pump 2, and repeats the same cycle and is ground progressively. When ground to a certain extent, the particle size of the slurry is measured occasionally, and when reaching a desired particle size, the material pump is stopped, and then the motor 12 is stopped to stop operation of the mill 3, thereby finishing the grinding process. Later, the valves 58 and 59 are opened, and the valves 61 and 62 are closed, and the material pump and motor 12 are started again, and then the valve 60 is opened. As a result, the product slurry in the material tank 1 is discharged by the material pump 2 and sent into a product tank 63, while the product slurry in the mill is agitated by rotation of the rotor 7 and pushed out through the screen 18 by compressed air or $N_2$ gas passed through the valve 60 and discharge route 9, or fed into the mill from above the mill and sent into the product tank 63. In this way, the product slurry in the material tank and mill 3 is recovered in the product tank 63. Meanwhile, rotation of the rotor 7 during product recovery is intended to prevent clogging in the screen 18 by mixing so that the media may not sediment in the mill and be collected in the mill lower layer, and proper compressed air or $N_2$ gas for clearing the clogging is introduced from the take-out port, and the screen 18 is back washed.

EXPERIMENT

Figure 9:
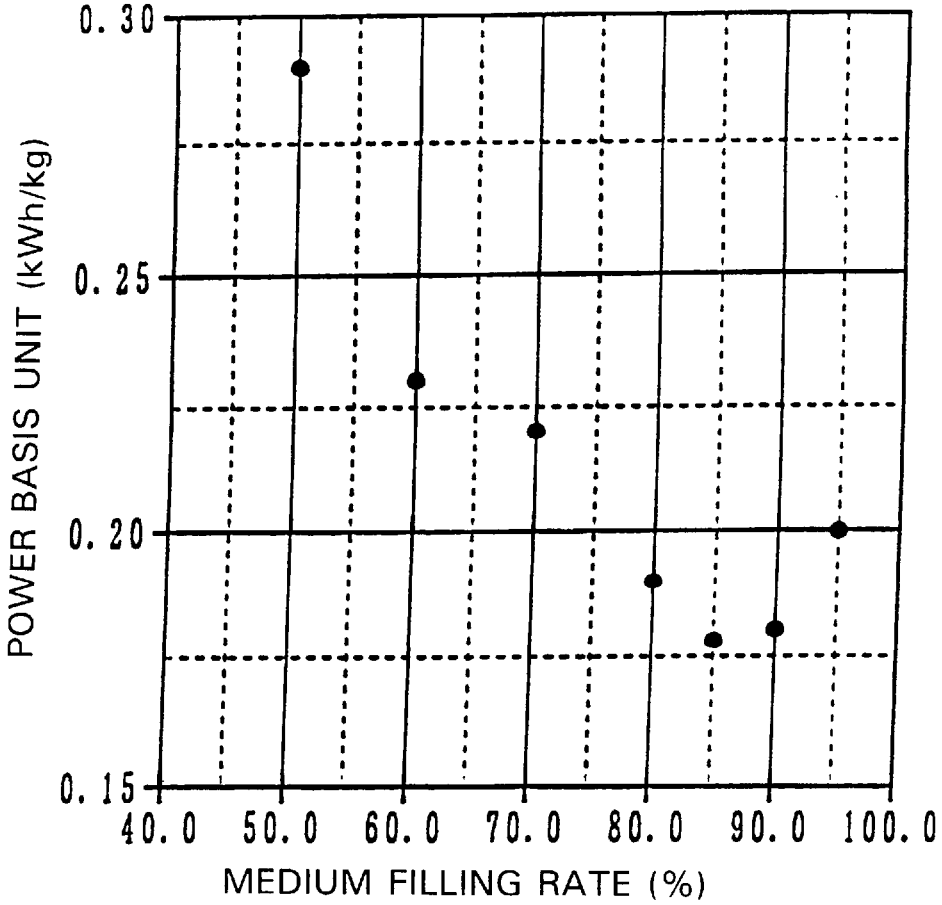
FIG. 9 is a diagram showing the relationship of media filling rate and mill power basic unit.

In FIG. 1, using a mill with an inside diameter of the stator 7 of 80 mmø, inner volume of 1 liter, diameter of separator 4 of 60 mmø, and interval of disks 21 of the separator 4 of 5 mm, the mill was filled with zirconia $ZrO_2$ (specific gravity 6.0) having a particle size of 0.1 mm as the media by 50%, and a slurry of calcium carbonate $CaCo_3$, with a mean particle size of 6.6 $\mu$m and water was supplied from the material tank 1 into the feed port 16. The mill 3 was operated at a constant rotor rotating speed (peripheral speed at the rotor leading end of 8 m/sec), and the slurry was ground cyclically. When the mean diameter reached the target of 1.0 $\mu$m, the mill operation was stopped, and product slurry was obtained. The experiment was conducted by varying the media filling rate from 50 to 95%, and from the required power kWh, the power basic unit for obtaining 1 kg of product slurry was determined. The result is shown in FIG. 9. As is clear from FIG. 9, the power basic unit decreased at the media filling rate of 80 to 90%, and the most efficient grinding was confirmed in this range.

What is claimed is:

1. A method of grinding a raw slurry comprising the steps of:

providing a wet agitating ball mill comprising a stator, a rotor contained in the stator, a grinding media contained in the stator, a separator for separating the grinding media from ground slurry provided at an upper location in said stator, a screen for separating the grinding media from the ground slurry provided at a lower location in said stator and a feed port for introducing the raw slurry into the stator provided underneath said stator, said feed port comprising a valve which is spring-biased against the flow of raw slurry into the stator;

rotating the rotor;

feeding the raw slurry through the feed port to upwardly displace the spring-biased valve and allow the raw slurry to enter into the stator;

grinding the raw slurry with the grinding media to produce the ground slurry; and discharging ground slurry from the separator and out of the stator.

2. A method of grinding a raw slurry comprising the steps of:

providing a wet agitating ball mill comprising a stator, a rotor contained in the stator, a grinding media contained in the stator, a separator for separating the grinding media from ground slurry provided at an upper location in said stator, a screen for separating the grinding media from the ground slurry provided at a lower location in said stator and a feed port for introducing the raw slurry into said stator;

rotating the rotor;

feeding the raw slurry through the feed port into said stator;

grinding the raw slurry with the grinding media to produce the ground slurry;

discharging ground slurry from the separator and out of the stator; and introducing a compressed gas through an upper portion of said stator to force the ground slurry through said screen and out of said stator.

3. A method of grinding a raw slurry comprising the steps of:

providing a wet agitating ball mill comprising a stator, a rotor contained in the stator, a separator for separating the grinding media from ground slurry and a feed port for introducing the raw slurry into said stator;

feeding a grinding media into said stator until said grinding media is contained in said stator in an amount of from greater than 80–90% of the volume of said stator;

rotating the rotor;

feeding the raw slurry through the feed port into said stator;

grinding the raw slurry with the grinding media to produce the ground slurry; and discharging ground slurry from the separator and out of the stator.

4. The grinding method of claim 3, wherein a vertical mill is used.

5. A wet agitating ball mill comprising a cylindrical stator; a feed port for raw slurry provided underneath the stator, said feed port comprising a valve which is spring-biased against the flow of raw slurry into the stator; a discharge port for ground slurry provided at an upper end of said stator; a grinding media contained in said stator; a rotatable shaft extending along the axis of said stator; means for rotating said rotatable shaft; a rotor mounted on said rotatable shaft for agitating and mixing the grinding media and the raw slurry to produce the ground slurry; and an impeller separator for separating ground slurry from grinding media by centrifugal force provided at an upper location in said stator, said impeller separator comprising upper and lower disks joined together by blade members and a discharge passage in fluid communication with the discharge port.

6. The ball mill of claim 5, wherein said impeller separator is mounted on said rotatable shaft.

7. The ball mill of claim 5, wherein a second, independently rotatable shaft is coaxially provided in said stator and said impeller separator is mounted thereon.

8. A wet agitating ball mill comprising a cylindrical stator; a feed port for raw slurry provided at one end of the stator; a discharge port for a ground slurry provided at an opposite end of said stator; a grinding media provided in said stator; a rotatable shaft extending along the axis of said stator; means for rotating said rotatable shaft; a rotor mounted on said rotatable shaft for agitating and mixing the grinding media and the raw slurry to produce the ground slurry; and an impeller separator for separating ground slurry from grinding media by centrifugal force, said impeller separator comprising upper and lower disks joined together by blade members and a discharge passage in fluid communication with the discharge port.

9. The ball mill of claim 8, wherein the mill is a vertical mill, and the discharge port is provided at the mill upper end.

10. The ball mill of claim 9, wherein the feed port is provided at the stator bottom, and is composed of a valve seat, and a valve body of a V-form, trapezoid or cone fitted elevatably to the valve seat and contacting linearly with the edge of the valve seat.

11. The ball mill of claim 10, wherein the valve body is vibrated vertically by a vibrating means.

12. The ball mill of claim 8, wherein a screen for separating media and slurry and a slurry take-out port are provided at the bottom of the stator.

13. The ball mill of claim 8, wherein the rotor is selected from the group consisting of a pin rotor, a disk rotor and an annular rotor.

14. A wet agitating ball mill comprising a vertical cylindrical stator; a feed port for raw slurry provided at the bottom of said stator; a discharge port for a ground slurry provided at an upper end of the stator; a grinding media provided in said stator; a rotatable shaft extending along the axis of said stator; means for rotating said rotatable shaft; bearing means for supporting said rotatable shaft provided at an upper portion of said stator; a rotor mounted on said rotatable shaft for agitating and mixing the grinding media and the raw slurry to produce the ground slurry; a separator provided in said stator near said discharge port for separating ground slurry from grinding media; and a mechanical seal provided in the bearing means, said mechanical seal comprising an O-ring and a mating ring contacting with said O-ring provided in annular grooves formed in the stator, said O-ring being provided in an annular groove having a downwardly extending tapered notch extending from a bottom portion thereof.

15. A wet agitating ball mill comprising a cylindrical stator; a feed port for raw slurry provided in said stator; a discharge port for ground slurry provided in said stator; a grinding media provided in said stator; a rotatable shaft extending along the axis of said stator; means for rotating said rotatable shaft; a rotor mounted on the rotatable shaft for agitating and mixing the grinding media and the raw slurry to produce the ground slurry; a separator for separating the grinding media from the ground slurry, said separator comprising a pair of disks having fitting grooves provided therein and blade member extending between said disks and fitted in said fitting grooves, and support means for supporting said separator in said stator.

16. The ball mill of claim 15, wherein the support means is composed of a step of the shaft and cylindrical pressing means fitted to the shaft.

* * * * *